US006009843A

United States Patent [19]

Griffin et al.

[11] Patent Number: 6,009,843

[45] Date of Patent: Jan. 4, 2000

[54] FIBER REINFORCED, TITANIUM COMPOSITE ENGINE VALVE

[75] Inventors: Christopher J. Griffin, Inver Grove Heights; Charles J. Skowronek, Minnetonka; James P. Sorensen, Eagan, all of Minn.

[73] Assignee: 3M Innovative Properties Company, St. Paul, Minn.

[21] Appl. No.: 08/955,792

[22] Filed: Oct. 22, 1997

[51] Int. Cl.[7] ..... F01L 3/02

[52] U.S. Cl. ..... 123/188.3; 29/888.45; 29/888.452

[58] Field of Search ..... 123/188.3; 29/888.45, 29/888.452

[56] References Cited

U.S. PATENT DOCUMENTS

| | | | |
|---|---|---|---|
| 3,636,605 | 1/1972 | Vitcha et al. . | |
| 3,711,171 | 1/1973 | Orkin et al. . | |
| 3,813,509 | 5/1974 | Woods et al. . | |
| 3,837,356 | 9/1974 | Selep et al. . | |
| 3,917,110 | 11/1975 | Kiguchi . | |
| 4,004,889 | 1/1977 | Gale et al. . | |
| 4,050,956 | 9/1977 | de Bruin et al. . | |
| 4,073,474 | 2/1978 | Hashimoto et al. . | |
| 4,074,671 | 2/1978 | Pennila . | |
| 4,122,817 | 10/1978 | Matlock . | |
| 4,149,910 | 4/1979 | Popplewell . | |
| 4,155,492 | 5/1979 | Seaton . | |
| 4,301,213 | 11/1981 | Davies . | |
| 4,347,076 | 8/1982 | Ray et al. . | |
| 4,359,022 | 11/1982 | Nakamura et al. . | |
| 4,410,285 | 10/1983 | Strasser et al. . | |
| 4,433,652 | 2/1984 | Hotzberg et al. . | |
| 4,556,022 | 12/1985 | Yamada et al. . | |
| 4,597,367 | 7/1986 | Hayashi . | |
| 4,606,883 | 8/1986 | Wizemann et al. . | |
| 4,632,074 | 12/1986 | Takahashi et al. . | |
| 4,729,546 | 3/1988 | Allison . | |
| 4,770,549 | 9/1988 | Rokkaku et al. . | |
| 4,834,036 | 5/1989 | Nishiyama et al. . | |
| 4,846,837 | 7/1989 | Kurze et al. . | |
| 4,852,531 | 8/1989 | Abkowitz et al. . | |
| 4,867,116 | 9/1989 | de Freitas Couto Rosa et al. . | |
| 4,872,431 | 10/1989 | Akao et al. . | |
| 4,881,500 | 11/1989 | Kojima et al. . | |
| 4,883,778 | 11/1989 | SinghDeo et al. . | |
| 4,928,645 | 5/1990 | Berneburg et al. . | |
| 5,022,918 | 6/1991 | Koike et al. . | |
| 5,076,866 | 12/1991 | Koike et al. | 148/437 |
| 5,094,200 | 3/1992 | Fontichiaro . | |
| 5,112,415 | 5/1992 | Mae . | |
| 5,169,460 | 12/1992 | Mae . | |
| 5,370,092 | 12/1994 | Shimizu et al. . | |
| 5,370,364 | 12/1994 | Kenomoku et al. | 123/188.3 |
| 5,503,122 | 4/1996 | Ritland et al. | 29/888.45 |
| 5,517,956 | 5/1996 | Jette et al. | 123/188.3 |
| 5,662,745 | 9/1997 | Takayama et al. | 123/188.3 |
| 5,720,246 | 2/1998 | Griffin et al. | 123/90.61 |
| 5,823,158 | 10/1998 | Heimann, Jr. et al. | 123/188.3 |

FOREIGN PATENT DOCUMENTS

| | | | |
|---|---|---|---|
| 32 43 560 | 5/1984 | Germany | 123/188.3 |
| 39 14 262 | 10/1990 | Germany | 123/188.3 |
| 1300752 | 12/1972 | United Kingdom . | |
| 2179369 | 3/1987 | United Kingdom . | |

*Primary Examiner*—Erick R. Solis
*Attorney, Agent, or Firm*—Gregory D. Allen

[57] ABSTRACT

Lightweight, strong, engine valves that incorporate a valve stem made from a refractory monofilament-reinforced, titanium-based metal matrix composite. Advantageously, the composite of the present invention is sufficiently strong so that valve stems incorporating the composite can be hollow for providing significant weight reduction while meeting valve stem strength and stiffness specifications. The valve includes a valve stem comprising a first end, a second end, and EL longitudinal axis extending from the first end to the second end. The valve stem comprises a composite incorporating a titanium-based metal binder matrix and an axially aligned cluster of continuous, refractory monofilaments incorporated in the binder matrix. A valve head is provided at one end of the valve stem, and a valve tip is provided at the other end. The invention also relates to a method of making such valves. The invention further relates to a composite assembly from which such valves may be machined.

26 Claims, 9 Drawing Sheets

FIBER REINFORCED, TITANIUM COMPOSITE ENGINE VALVE

FIELD OF THE INVENTION

This invention relates to valves for use in internal combustion engines, and more particularly to such valves having composite stems incorporating a titanium-based metal matrix reinforced with continuous, refractory monofilaments.

BACKGROUND OF THE INVENTION

Four-cycle internal combustion engines typically Lise at least two valves per cylinder, one being an intake valve and the other an exhaust valve. Many of these engines even use three or more valves per cylinder. For example., some engines include two intake valves and two exhaust valves per cylinder. The valves of an internal combustion engine are operated by a valve actuating mechanism that typically is either a pushrod or an overhead camshaft valve train. The valve actuating mechanism translates rotating motion from the rotating camshaft of the engine into reciprocal linear motion of the individual valves.

The multiplicity of moving parts, the mass, and the high energies and revolutions involved in modern combustion engines often result in not only significant amounts of undesired vibration and noise, but can also result in decreased engine speed and efficiency. It has long been recognized that improvements to the valve train components can lead to significant improvements in overall engine performance. More particularly, valves of reduced weight offer the potential to lower engine noise, increase engine speed, increase engine power, and improve fuel efficiency.

In one approach for reducing the weight of valves, valves have been formed from titanium alloys, which generally are characterized by a combination of lightweight, high strength, temperature resistance, and corrosion resistance. Valves made from titanium alloys have been described, for example, in U.S. Pat. Nos. 5,112,415 (Mae); 5,370,092 (Shimizu et al.); and 4,729,546 (Allison).

In another approach, valves formed from composites have been described. For example, U.S. Pat. No. 4,928,645 (Berneburg et al.) describes a ceramic composite valve whose valve stem includes a fibrous ceramic sleeving packed with axially aligned fibers. U.S. Pat. No. 4,852,531 (Abkowitz) describes a valve whose composite valve stem includes a titanium alloy strengthened with particles of TiC, TiB, or $TiB_2$.

The two approaches described above involve the use of solid valve stems. In a further effort to reduce weight, hollow valve stems have also been proposed. For example, U.S. Pat. No. 4,834,036 (Nishiyama et al.) describes a valve with a hollow valve stem formed from a high strength alloy steel. The high strength of such steel makes a hollow valve stem technically feasible. However, even with a hollow stem, such valves are still relatively heavy.

There still remains a need, therefore, for lighter weight valves to further improve the efficiency, performance, and power output of internal combustion engines. Specifically, lighter weight valves would offer potential for higher attainable engine rpm, more attainable horsepower, longer service life, less engine noise, and better fuel economy.

SUMMARY OF THE INVENTION

The present invention provides lightweight, strong, engine valves that incorporate a valve stem made from a fiber-reinforced, titanium-based metal matrix composite. Advantageously, the composite of the present invention, is so strong that valve stems incorporating the composite can be hollow for providing significant weight reduction while easily meeting valve stem strength specifications. For example, hollow valve stem embodiments of the present invention can weigh, for example, 20% to 25% less than valves incorporating solid valve stems made from titanium alloys or other titanium composites. Not only are hollow valve stems of the present invention lighter than solid valve stems incorporating titanium-based metals, hollow valve stems of the present invention are stronger and stiffer at comparable engine operating temperatures. Preferably, at least a portion the fibers or monofilaments extend substantially continuously from one end of the value stem to the other.

As another advantage, the fiber reinforced, titanium-based metal matrix composite generally has a lower coefficient of thermal expansion than titanium alloys. Thus, valve trains incorporating valves of the present invention can be operated with tighter tolerances.

In one aspect, the present invention relates to a valve for an internal combustion engine. The valve includes a valve stem comprising a first end, a second end, and a longitudinal axis extending from the first end to the second end. The valve stem comprises a composite incorporating a titanium-based metal binder matrix and an axially aligned cluster of continuous, refractory monofilaments incorporated in the binder matrix. A valve head is provided at the first end of the valve stem, and a valve tip is provided at the second end of the valve stem.

In another aspect, the present invention relates to a hollow composite assembly comprising a composite sleeve having a first end, a second end, an inner surface, and an outer surface. The composite sleeve incorporates a titanium-based metal binder matrix and an axially aligned cluster of continuous, refractory monofilaments incorporated in the binder matrix.

In another aspect, the present invention relates to a method of making an internal combustion engine valve of the type in which a valve head is attached to a valve stem having a longitudinal axis. The method comprises the steps of (a) providing a cluster of axially aligned, refractory monofilaments, wherein each monofilament comprises a coating including a titanium-based metal;

(b) subjecting the cluster of axially aligned, coated monofilaments to conditions effective to form a composite body comprising the monofilaments incorporated in a binder matrix comprising the titanium-based metal; and (c) incorporating at least a portion of the composite into the valve stem of the valve such that the monofilaments of the composite are substantially parallel to the longitudinal axis of the stem.

BRIEF DESCRIPTION OF THE DRAWING

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

Figure 1:
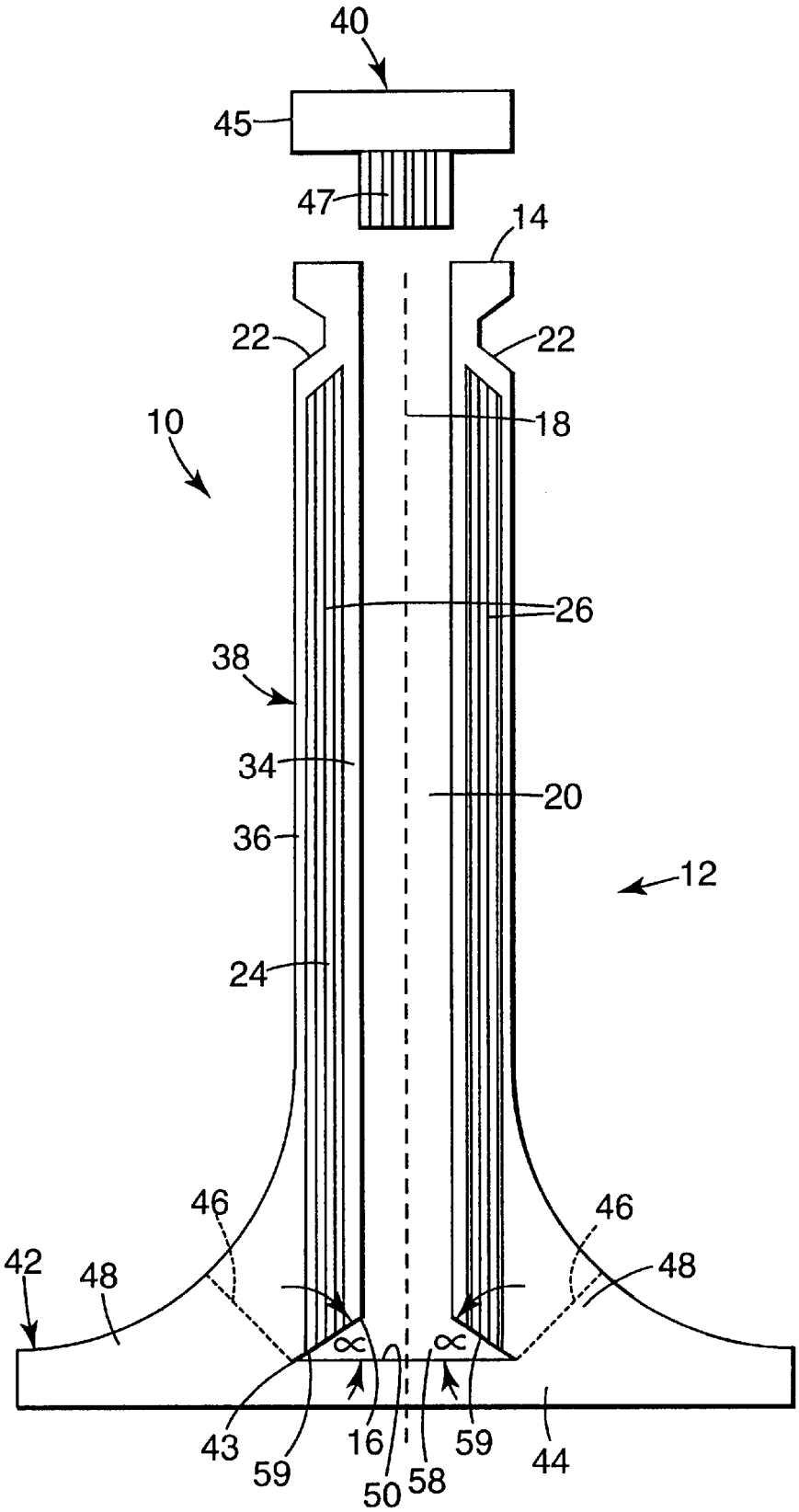
FIG. 1 is a side view of a valve according to the present invention shown in cross-section (cross-section lines removed for clarity)
Figure 2:
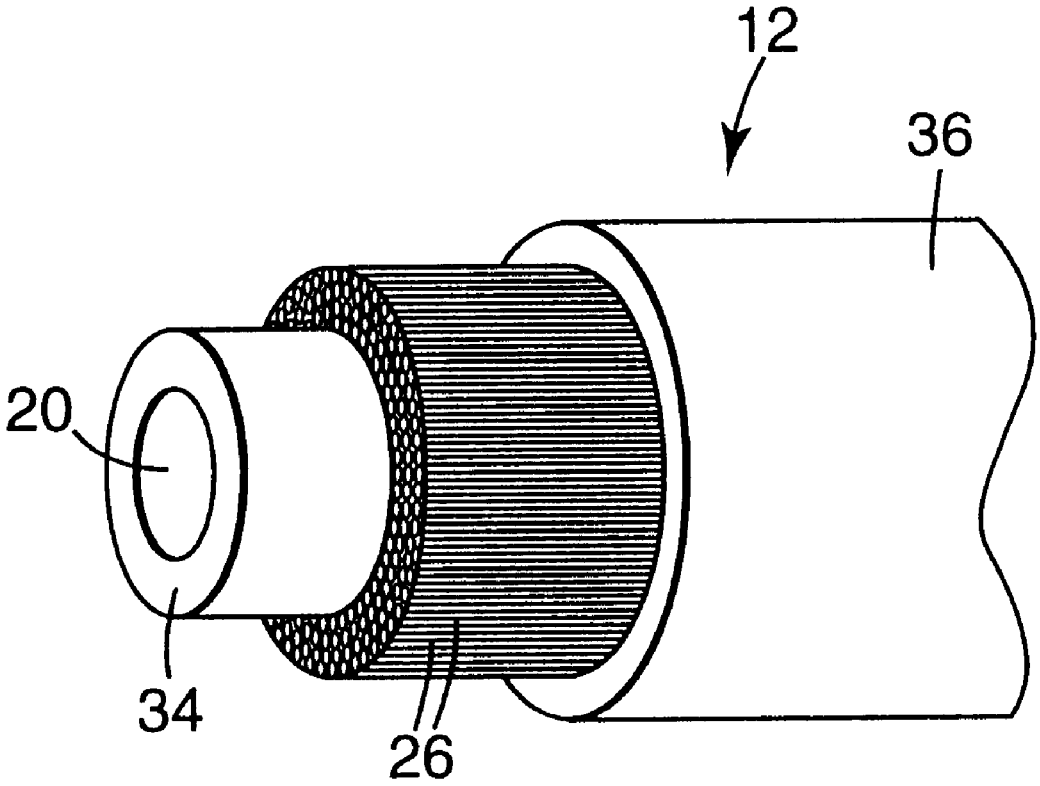
FIG. 2 is a schematic perspective view of a portion of the valve stem of FIG. 1 with parts broken away to better show the structure of the valve stem.

One embodiment of a valve according to the present invention is shown in FIGS. 1 and 2. Valve 10, which may be an intake valve or an exhaust valve, includes composite valve stem 12, valve head 42, and valve tip 40. Composite valve stem 12 has a first end 14, second end 16, and a longitudinal axis 13 extending from first end 14 to second end 16. Preferably, as shown, valve stem 12 is provided with central lumen 20 extending through valve stem 12 in order to help reduce the weight of valve 10. Optionally, if desired, for example, to provide extra strength, valve stem 12 could be formed without lumen 20; but such a solid valve stem would be heavier than hollow valve stem 12 as shown. Valve stem 12 (as shown) has keeper groove 22 proximal to first end 14 in order to facilitate operative engagement with a corresponding valve actuating mechanism (not shown). Although valve 10 is shown as having only one keeper groove 22, the number and shape of such keeper grooves is not critical and any number or convenient shape can be used as desired.

Referring to FIGS. 1 and 2, composite valve stem 12 incorporates a titanium-based metal binder matrix 24 and an axially aligned cluster of continuous, refractory, reinforcing monofilaments 26 incorporated in the titanium-based metal binder matrix 24. In the preferred embodiment shown, monofilaments 26 are positioned in the core of valve stem 12 so that there are monofilament-free, titanium-based metal, inner and outer regions 34 and 36 lining the inner and outer wall surfaces of the valve stem 12. Inner and outer regions 34 and 36 help ensure that there are no exposed monofilaments 26 along the length of valve stem 12, thus protecting monofilaments 26 from damage that might occur if portions of monofilaments 26 were exposed. Inner region 34 also functions as an expanding "bladder" during the hot isostatic pressing (HIPing) procedure described below, helping to densify the composite. Generally, each of inner and outer regions 34 and 36 preferably has a thickness on the order of 25 micrometers to 100 micrometers. The overall thickness of the wall of valve stem 12 may vary depending, for example, upon the kind of engine in which valve 10 is to be used. Generally, thicknesses of 1 mm to 4 mm would be suitable in many applications.

Preferably, direct contact between any two monofilaments 26 is avoided as much as is practically possible. More preferably, substantially no monofilament 26, and most preferably no monofilament 26 at all, directly contacts any other monofilament 26 within the matrix. Rather, each monofilament 26 is preferably individually encapsulated by binder matrix 24 to ensure that monofilaments 26 are spaced apart from each other. It is believed that this configuration helps maximize the strength of valve stem 12, because stresses resulting from a failure of one monofilament 26 are more likely to be absorbed by and dissipated in matrix 24 and less likely to propagate and cause failure of adjacent monofilaments. As another preferred characteristic of valve stem 12, it is believed that substantially uniform distribution of monofilaments 26 throughout the core of valve stem 12 significantly increases the strength characteristics of valve stem 12. Uniform monofilament distribution is also believed to provide more uniform thermal expansion characteristics, thereby allowing better tolerances to be maintained for valve 10.

Referring again collectively to FIGS. 1 and 2, at least a plurality, preferably substantially all, and more preferably all, of monofilaments 26 are continuous. Use of continuous monofilaments 26 is believed to optimize the strength characteristics of valve stem 12. "Continuous" means that the monofilaments of the composite generally have a length that substantially approximate, the length of the valve stem 12 into which monofilaments 26 are incorporated. Most preferably, monofilaments 26 extend continuously from one end of the valve stem 12 to the other in order to maximize the stiffness and strength of the composite. Such composite structures incorporating long lengths of monofilaments that substantially approximate the length of the valve stem 12 are to be contrasted to structures in which reinforcing "whiskers" or relatively short lengths of chopped fibers, are used. At least a plurality, preferably substantially all, and most preferably all, of the monofilaments 26 of the monofilament cluster are axially aligned. "Axially aligned" means that a particular monofilament 26 is generally parallel to longitudinal axis 18 of valve stem 12. A cluster having such axial alignment characteristics allows for close, high density packing of monofilaments 26, thus providing a strong, stiff, rigid composite.

Monofilaments 26 may be formed from any suitable refractory composition that is compatible with the titanium-based metal binder matrix 24. Selection of an appropriate type of refractory composition for use in monofilaments 26 will depend upon a variety of factors including the process used to form valve stem 12, the composition of titanium-based binder matrix 24, and the like. Representative examples of suitable refractory compositions include silicon carbide, boron, and $\alpha$-$Al_2O_3$ (e.g., single crystal $\alpha$-$Al_2O_3$).

Preferably, monofilaments 26 are silicon carbide monofilaments. Silicon carbide is preferred for several reasons. Firstly, silicon carbide monofilaments are commercially available in a range of diameters from suppliers such as Textron Specialty Materials, Lowell, Mass. Silicon carbide fibers also have an advantageous combination of characteristics including reasonable cost, strength, and strength retention at elevated temperatures (e.g., temperatures in the range from 300° C. to 1000° C.). Further, silicon carbide monofilaments tend to be manufactured with a carbon-rich outer layer that is believed to be particularly beneficial when valve stem 12 is manufactured using the hot isostatic procedure described below. Specifically, the carbon-rich outer layer is believed to act as a sacrificial coating that reacts with the titanium-based material of binder matrix 24 in a manner such that the silicon carbide core of the fibers is protected and remains structurally intact durirng consolidation of the titanium-based material of binder matrix 24.

Monofilaments 26 preferably have a circular cross-section and may be provided in any desired diameter, or combination of diameters, as desired. Selection of an appropriate monofilament diameter will depend, for example, upon a variety of factors including the thickness of the valve stem wall, the desired strength specifications of the resultant valve stem 12, the technique used to make valve stem 12, the desired packing density, and the like. Generally, using monofilaments with a diameter in the range from 50 micrometers to 200 micrometers, preferably 100 micrometers to 150 micrometers, would be suitable in the practice of the present invention. One example of a preferred silicon carbide monofilament has a diameter of 142 micrometers and is available under the trade designation "SCS-6" from Textron Specialty Materials, Lowell, Mass.

The volume fraction of monofilaments 26 incorporated into the composite will depend upon a variety of factors, including the diameter of monofilaments 26, the dimensions of the valve stem 12 into which the monofilaments 26 are to be incorporated, the desired strength characteristics of valve stem 12, and the like. Generally, in order to optimize the cost and strength of valve 10, it is desirable to have as few refractory monofilaments 26 as possible as are needed to achieve desired strength specifications. On the other hand, it is desirable to use a sufficient number of monofilaments 26 to ensure that monofilaments 26 are uniformly distributed throughout valve stem 12 and are not significantly displaced during processing. Balancing these concerns of using a sufficient number of monofilaments typically results in valve stem core region 38 preferably including 15 to 60, more preferably about 30 to 40, most preferably about 35 volume percent of refractory monofilaments.

Titanium-based metal binder matrix 24 preferably includes a rigid, titanium-based metal composition comprising at least about 30 percent by weight of titanium, and up to 70 percent by weight of one or more other constituents (e.g. aluminum, iron, molybdenum, silicon, and vanadium). Binder matrix 24 may be derived from a wide variety of titanium-based metals. Representative examples of such titanium-based metals include titanium alloys, intermetallic compositions including titanium and at least one other metal, substantially pure titanium, combinations of these, and the like. Advantageously, such titanium-based metals typically have excellent strength to weight characteristics, corrosion resistance, and high heat resistance. This combination of characteristics makes titanium-based metals extremely suitable for forming valve parts with outstanding performance and long service life, particularly in demanding operating environments such as racing car engines. As used herein, substantially pure titanium refers to titanium metal containing less than 0.5% by weight, more preferably less than 0.2% by weight of impurities.

Titanium alloys suitable for use in the titanium-based metal binder matrix 24 of the present invention typically include about 80 weight percent of titanium and up to about 20 weight percent of one or more other metal constituents. Generally, any titanium alloy that maintains acceptable levels of strength and corrosion resistance under the desired engine operating conditions may be used in the present invention. Representative examples of suitable titanium alloys would include Ti-6Al-4V; Ti-6Al2Sn-4Zr-2Mo-0.15Si; Ti-6Al-2Sn-4Zr-2Mo; Ti-10V-2Fe-3Al; Ti-5Al-2.5Sn; Ti-5Al-6Sn-2Zr-1Mo-0.3Si; Ti-3Al-2.5V; Ti-5Al-5Sn-2Zr-4Mo-0.3Si; Ti-6Al-6V-2Sn; Ti10V-2Fe-3Al; Ti-5Al-2.5Sn; combinations of these and the like. In these formulations, the numbers associated with an alloy constituent refer to the weight percent of that constituent in the alloy. For example, Ti-6Al-4V includes 6 weight percent aluminum, 4 weight percent vanadium, and the balance (90 weight percent) tiltanium. In preferred embodiments of the invention, core region 38 of titanium-based binder matrix 24 includes the titanium alloy Ti-6Al-4V (commercially available under the trade designation "Ti-6-4" from Americana Metal Service, Inc., Cincinnati, Ohio), and inner and outer regions 34 and 36 include the titanium alloy Ti-6Al-2Sn-4Zr-2Mo (commercially available under the trade designation "Ti-6-2-4-2" from Americana Metal Service, Inc., Cincinnati, Ohio).

Generally, intermetallic compositions including titanium comprise up to 70 parts by weight of titanium and at least about 25 parts by weight of one or more other metal constituents. Intermetallic compositions comprising titanium are distinguishable from titanium alloys in that bonds between atoms of an intermetallic compound are not truly metallic, but rather are partially covalent. As a result, such bonds are characterized by some directionality between atoms. thence, intermetallic compositions generally have good stiffness, high hardness, well-defined stoichiometries, and congruent melting points. Intermetallic compositions of the present invention may include intermetallic stoichiometric compositions, such as $Ti_3Al$, TiAl, and/or $TiAl_3$, as well as the so-called substantially stoichiometric compositions. For example, substantially stoichiometric counterpart compositions of TiAl can include from about 35 to about 45 parts by weight aluminum and about 55 to about 65 parts by weight titanium. Similarly, substantially stoichiometric counterpart compositions of $TiAl_3$ may include about 63 parts by weight aluminum and about 37 parts by weight of titanium. In addition to the main metallic constituents, which are Al and Ti with respect to $Ti_3Al$, TiAl, and $TiAl_3$, the intermetallic compositions rmlay optionally include one or more additives such as Ni, Nb, W, V, Mn, B, and the like, in order to enhance the properties of the intermetallic compositions. Representative examples of intermetallic compositions incorporating such additives include Ti-36Al-5Nb; Ti-22Al-23Nb; Ti-16Al-10Nb; Ti-14Al-21Ni; and the like.

Valve tip 40 is attachable to first end 14 of valve stem 12 in order to provide valve 10 with an abrasion resistant surface for operative engagement with the corresponding valve actuating mechanism. Valve tip 40 may be formed in any of a wide variety of shapes to operationally engage the mating fixtures of the valve actuating mechanism (not shown). As shown, valve tip 40 has a cylindrical end cap 45 and a knurled shank 47 that is adapted to be press fit into first end 14 of valve stem 12. If desired, valve tip 40 may be adapted for attachment to valve stem 12 using any other convenient attachment technique, including electron beam welding, diffusion bonding, and the like. Valve tip 40 may be formed from a variety of wear resistant, refractory materials including metals, metal alloys, intermetallic compositions, ceramic compositions, combinations thereof, and the like. Specific examples of suitable materials for forming valve tip 40 include 4130, 4340, or 8620 alloy steels, combinations thereof, or the like. Of these, 4340 alloy steel hardened to a Rockwell hardness of at least 60 (available from, for example American Metal Service, Cincinnati, Ohio) is preferred.

Valve head 42 is provided on the second end of valve stem 12. The juncture between valve head 42 and valve stem 12 is schematically shown by dotted line 46. When diffusion bonding is used to attach these two components to each other, the juncture between the two is practically indiscernible. Valve head 42 includes valve face 44 and inner surface 50. Valve head fillet 48 braces and reinforces the connection between valve head 42 and valve stem 12. Valve head 42 may be formed from a wide range of tough, wear resistant, refractory materials including metals, metal alloys, intermetallic compositions, ceramic compositions, combinations thereof, and the like. Preferred examples of suitable materials for forming valve head 42 include the titanium-based alloys, intermetallics, and metals described above. Of these, the titanium alloys are preferred. The titanium alloy Ti-6Al-2Sn-4Zr-2Mo currently is most preferred.

Valve head 42 may be attached to valve stem 12 using any convenient attachment technique, including electron beam welding, diffusion bonding, brazing, and the like. Choosing an appropriate attachment technique will depend, in part, upon the composition of valve head 42. In preferred embodiments in which valve head 42 is formed from a titanium-based material such as Ti-6Al-2Sn-4Zr-2Mo, using diffusion bonding is a suitable way to securely attach valve head 42 to valve stem 12.

Referring to FIG. 1, valve 10 includes a particularly preferred structure that is advantageously used when valve head 42 is formed from a titanium alloy and valve 10 is formed by a method including a fabrication step in which blanks corresponding to valve head 42 and valve stem 12 are diffusion bonded to each other. Generally, a titanium alloy in the valve head blank tends to react with exposed portions of the monofilaments 26 contained in the valve stem blank if the titanium alloy and the fibers are allowed to come into physical contact during diffusion bonding. Such a reaction tends to produce brittle chemical reaction products in the ductile titanium alloy. These products may tend to act as stress risers and fatigue initiation sites during engine operation, weakening the valve enough to cause failure. Accordingly, to avoid these drawbacks, valve head 42 and valve stem 12 are preferably coupled to each other in a manner such that the ends 59 of monofilaments 26 at second end 16 of valve stem 12 are spaced apart from and do not directly contact the titanium-baised metal materials in valve head 42 during the manufacturing process or in use. Valves incorporating such spacing have been found to be stronger and have a longer service life than otherwise similar valves lacking such spacing.

A preferred structure for providing such spacing is shown in FIG. 1, wherein valve stem second end 16 is provided with an inverted taper to ensure that ends 59 of monofilaments 26 are spaced apart from inner surface 50 of valve head 42. The juncture between the inverted taper and valve head 42 forms an apex 43 characterized by an angle $\alpha$. The angle $\alpha$ of the taper is not believed to be particularly critical. So long as the desired spacing between ends 59 and valve head 42 is achieved, the angle $\alpha$ can be selected from a wide range with beneficial results. For example, the angle $\alpha$ may be in the range 15 to 75°, preferably 25° to 60°, most preferably about 30°, because tooling for machining tapers in such ranges, particularly 30°, is readily available.

The inverted taper at second end 16 of valve stem 12 and inner surface 50 of valve head 42 define flared cavity region 58 between second end 16 and valve head inner surface 50. Flared cavity region 58 is believed to offer numerous performance advantages that are counterintuitive. Firstly, as noted above, flared cavity region 58 provides desirable spacing between fiber ends 59 and valve head 42. Additionally, flared cavity region 58 also enhances the durability of valve 10, which is surprising in view of the fact that, in essence, flared cavity region 58 provides a crack tip 43 in valve head 42. Normally, such a crack tip would be expected to act like a stress concentrator from which stress-induced failure of valve head 42 could propagate during engine operation when a valve head tends to experience bending stresses. Such is not the case, however, with respect to flared cavity 58. Apex 43 of flared cavity 58 is positioned close enough to the neutral axis of such valve head bending so that crack growth and fatigue failure due to valve head bending are generally minimized, and more preferably substantially avoided.

Figure 3:
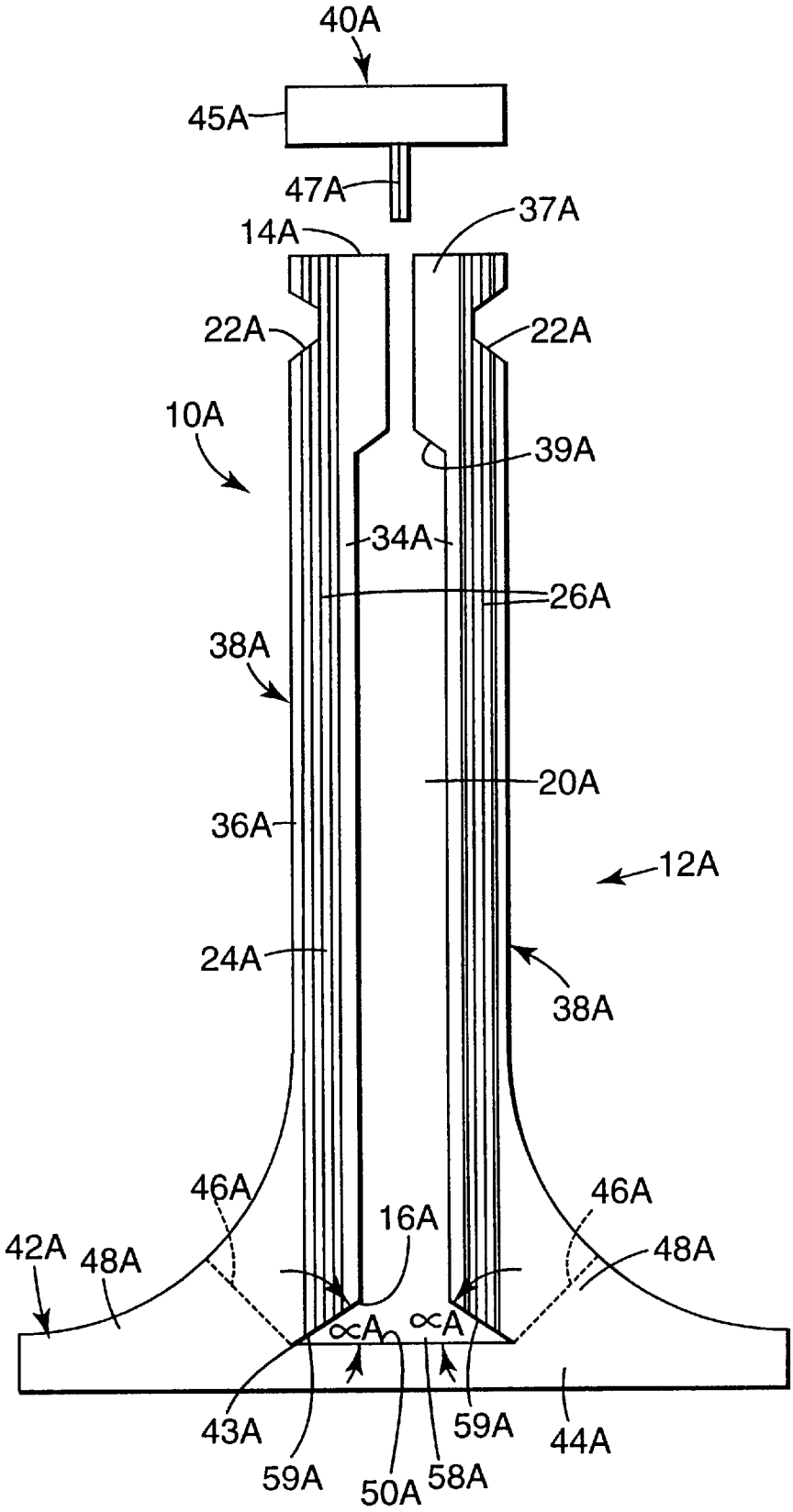
FIG. 3 is a side view of an alternative valve embodiment of the present invention shown in cross-section (cross-section lines removed for clarity)

An alternative embodiment of a valve 10A is shown in FIG. 3. Valve 10A of FIG. 3 is generally identical to valve 10 of FIGS. 1–2, and corresponding parts of FIG. 3 are identified with the same numbers as were used in FIG. 1, except that the suffix "A" is used on the numbers of FIG. 3. However, as one difference, inner sleeve 34A of FIG. 3 includes thickened portion 37A proximal to first end 14A of valve stem 12A in order to provide structural reinforcement underneath keeper groove 22A. Inboard end 39A of thickened portion 37A is chamfered in order to provide a gradual transition in thickness in order to facilitate mechanical load transfer and to help avoid undue stresses that might otherwise occur in the event that the transition in thickness were to be much more abrupt. Knurled shank 47A has a smaller diameter to fit into thickened portion 37A. As an additional difference, monofilaments 26A of FIG. 3 extend the full length of valve stem 12A. Valve 10A of FIG. 3 generally would have improved fatigue properties at the top of the stem. In addition to the above mentioned components, valve 10A also includes second end 16A, lumen 20A, metal binder matrix 24A, monofilament-free inner and outer regions 34A and 36A, middle matrix region 38A, valve tip 40A, cylindrical end cap 45A, valve head 42A, apex 43A, valve face 44A, juncture 46A, valve head fillet 48A, outer face 49A, inner surface 50A, angle $\alpha$A, flared cavity region 58A, and fiber ends 59A.

One approach for making a valve of the type shown in FIGS. 1–2 involves forming the valve stem by inserting coated monofilaments between concentric tubes, wherein the coating on the monofilaments comprises a Ti-baised material corresponding to binder matrix 24 of core region 38, and wherein the concentric tubes each independently comprise a Ti-based material corresponding to the composition of inner and outer sleeves 34 and 36, respectively. Generally, the thickness of the titanium-based coating on the monofilaments determines the volume fraction of the monofilaments in the resultant composite. The coating thickness also helps maintain a physical separation between individual monofilaments in the resultant composite. Hot isostatic pressing consolidates and densifies the materials to form, in effect, a single, integral composite body. The resultant composite serves as a valve stem blank that can be machined, as desired, and then joined to a suitable valve head blank. The assembled blanks can then be machined to the desired final dimensions to form a valve body. After machining, a valve tip can be attached to the top of the valve stem to thereby complete the valve.

Figure 4:
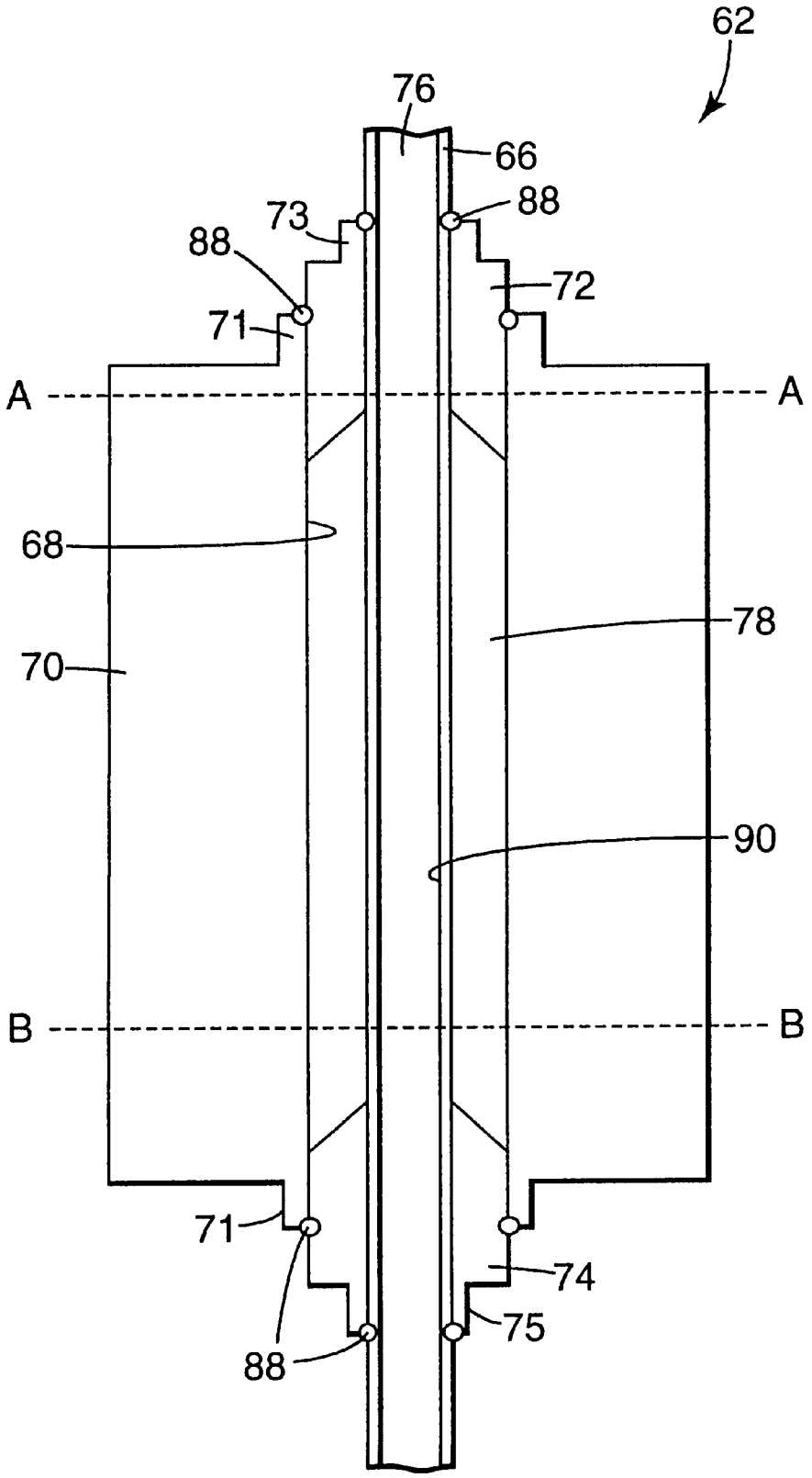
FIG. 4 is a side view, in cross-section, of tooling useful for making the valve stem of FIG. 1 (cross-section lines removed for clarity)

This approach will now be described in more detail in connection with FIGS. 4–8. FIG. 4 shows tooling 62 useful for forming a composite valve stem blank (not shown) which can be machined to form a valve stem (not shown). Tooling 62 includes cylindrical hollow inner tube 66 concentrically supported in bore 68 of cylindrical outer tube 70 by top collar 72 and bottom collar 74 positioned at the ends of inner tube 66. Lumen 76 extends axially through inner tube 66 As shown, each of top collar 72 and bottom collar 74 is a separate component of tooling 62. Other configurations can be used. For example, top collar 72 can be formed integrally with inner tube 66. As another option, bottom collar 74 could be formed integrally with inner tube 66, while top collar 72 is a separate piece. As still another option, both collars 72 and 74 can be integrally formed with inner tube 66, although such a configuration would be more difficult to insert into bore 68 of body 70 than an alternative configuration in which no more than one of the collars is integrally formed with inner tube 66.

The ends of outer tube 70 have shoulders 71 to facilitate attachment to collars 72 and 74. In a similar fashion, collars 72 and 74 each have shoulders 73 and 75, respectively, to facilitate attachment to inner tube 66.

Between collars 72 and 74, inner tube 66 is concentrically spaced apart from outer tube 70 to form tubular cavity 78. Collars 72 and 74 help maintain the concentricity between inner tube 66 and body 70. Tubular cavity 78 is configured to receive a composite preform comprising a cluster (not shown) of axially aligned monofilaments bearing a titanium-based metal coating. When the axially aligned monofilaments are placed in tubular cavity 78, collars 72 and 74 may be sealingly positioned at the top and bottom of inner tube 66, respectively, in order to hermetically seal tubular cavity 78 in preparation for hot isostatic pressing.

Portions of tooling 62 are intended to be incorporated into the corresponding valve stem blank, and thereafter the resultant valve, that are made using tooling 62. Specifically, the inner portion of outer tube 70 proximal to tubular cavity 78 becomes the outer region 36 of resultant valve 10; portions of inner tube 66 become inner region 34; and the coated monofilament cluster to be incorporated into tubular cavity 78 becomes middle matrix region 38. Accordingly, outer tube 70 is formed of the same material from which it is desired to form outer region 36 of valve 10 of FIGS. 1 and 2 and/or valve 10A of FIG. 3. Similarly, inner tube 66 is formed of the same material from which it is desired to form inner region 34 of valve 10, of FIGS. 1 and 2 and/or valve 10A of FIG. 3. In one embodiment, therefore, inner tube 66 is formed from commercially pure Ti, and outer tube 70 is formed from Ti-6Al-2Sn-4Zr-2Mo, as illustrated in FIGS. 1 and 2. In an alternative, preferred embodiment, the inner sleeve 34A, including thickened portion 37A of inboard end 39A, of valve 10A, and outer tube 70, is machined from Ti-6Al-2Sn-4Zr-2Mo alloy rod.

To use tooling 62, a suitable supply of refractory, monofilament, preferably a supply of silicon carbide monofilament, is coated with a titanium-based material corresponding to the titanium-based binder matrix of the composite to be incorporated into valve stem 12. The monofilament can be coated by vapor depositing the titanium-based material onto the monofilament. The coating should be thick enough to maintain physical separation between monofilaments in the resultant composite. On the other hand, the coating should be thin enough so that the desired volume fraction of refractory monofilament can be incorporated into the composite. Balancing these concerns, one suitable range of coating thickness for monofilaments would be from about 1 mil (about 25 micrometers) to about 2 mil (about 50 micrometers) for monofilaments having a diameter in the range from about 50 to 200 micrometers, more preferably about 100 to 150 micrometers. Techniques for vapor depositing titanium-based metals onto a fiber such as a silicon carbide monofilament have been described, for example, in C. M. Ward-Close et al., Journal of Materials Science, 25 (1990) 4315, the disclosure of which is incorporated herein by reference. Silicon carbide fibers having a titanium-based coating are also commercially available from the 3M Company, St. Paul, Minn.

Next, the coated monofilament is cut into a plurality of pieces whose length preferably corresponds to the axial length of tubular cavity 78. This ensures that the monofilaments extend substantially the full length of the resultant valve stem 12. A cluster (not shown) of axially aligned monofilaments is shaped and inserted into cavity 78. The precise number of monofilaments to be included in the cluster may be empirically established or calculated based upon the coated monofilament diameter, the uncoated filament diameter, the volume of cavity 78, and the desired volume percent of refractory content. However, it is generally preferred to insert as many of the coated monofilaments into cavity 78 as possible. Using as many coated monofilaments as possible more effectively controls the refractory content of the resultant composite and helps ensure that the axial alignment of the monofilament cluster is maintained during subsequent processing. A more densely packed cluster of the coated monofilaments also is much less likely to move out of alignment than a less dense cluster.

Typically, the coated monofilaments tend to be substantially circular in cross-section, hence the densest packing is achieved if the monofilaments are packed in a hexagonal close-packed array. Theoretically, a hexagonal close-packed array of perfectly round monofilaments having the same diameter could be packed to a volume packing fraction of 0.91. In practice, however, a packing fraction of 0.75 to 0.80 is more commonly achieved due to the fact that the coated monofilaments are typically not perfectly round and do not all have precisely identical diameters. Knowing the volume of cavity 78 to be filled, and the average diameter of the coated monofilaments, the number of monofilaments required to achieve practical packing densities can be calculated. For example, when using a cavity having inner and outer diameters of 0.46 cm and 0.86 cm respectively, and coated monofilaments with a diameter of 0.022 cm, about 550 to 600 coated monofilaments should fill cavity 78 effectively.

Figure 5:
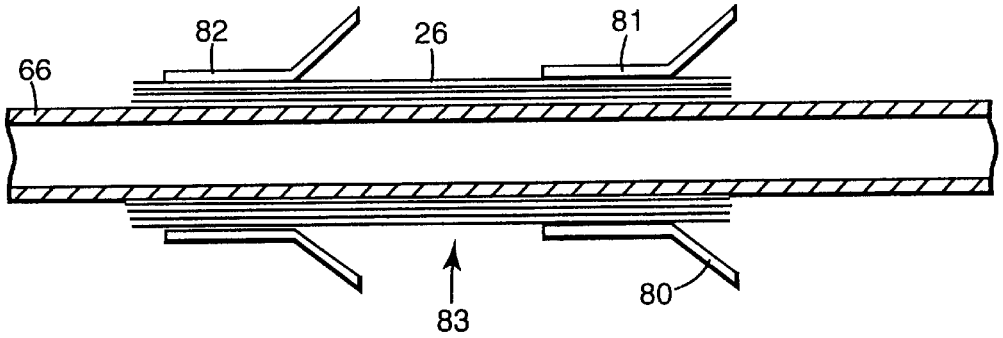
FIG. 5 is a side view, in cross-section, of tooling useful for making the valve stem of FIG. 1 (cross-section lines removed for clarity)
Figure 6:
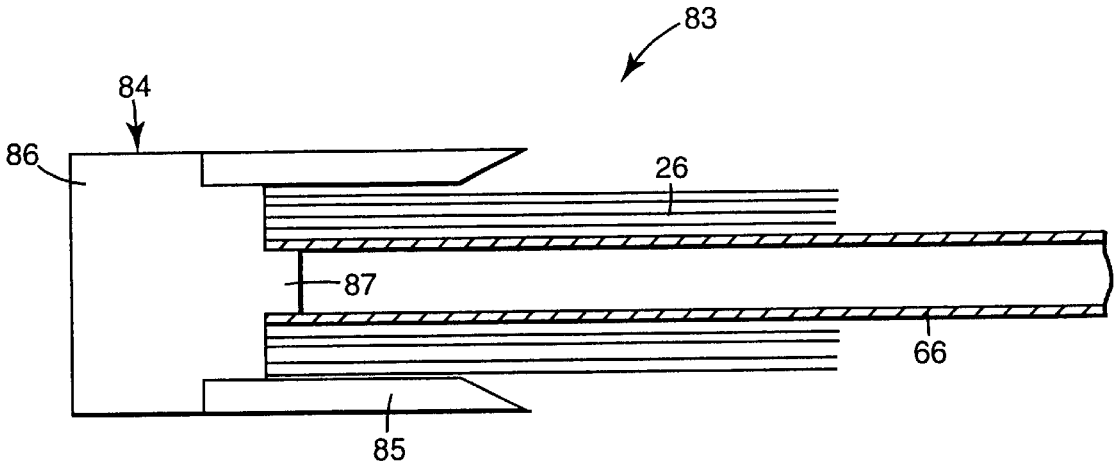
FIG. 6 is a side view, in cross-section, of tooling useful for making the valve stem of FIG. 1 (cross-section lines removed for clarity)

FIGS. 5 and 6 show one approach for inserting a cluster of axially aligned coated monofilaments into cavity 78. Referring first to FIG. 5, a cluster of the desired number of monofilaments 26 is formed around inner tube 66. At the outset, inner tube 66 also has a length that exceeds the length of outer tube 70 by an amount at least slightly longer than the length of the coated monofilaments in order to facilitate the technique to be presently described. The excess length of inner tube 66 may be cut off later. The monofilament cluster is formed around inner tube 66 about 2.5 cm from one end. The cluster is initially held in place by hand. The resultant monofilament/inner tube assembly 83 is then inserted into the flared end 80 of a funnel 81. Preferably, funnel 81 is formed from a transparent material such as glass so that the alignment of monofilaments 26 can be observed through the funnel 81. Funnel 81 is sized with an inside diameter that is slightly larger (e.g., 0.005 cm larger) than the inside diameter of outer tube 70 (FIG. 4). Flared end 80 of funnel 81 helps gather the monofilaments 26 around inner tube 66. Slight relative rotational oscillation between funnel 81 and inner tube 66 not only helps align monofilaments 26 but also reduces inter-monofilament spacing, thereby easing insertion of monofilaments 26 and inner tube 66 into funnel 81. The monofilament/inner tube assembly 83 may also be rolled back and forth between thumb and forefinger to further align and pack monofilaments 26 for insertion into funnel 81. A second funnel 82, also preferably made of a transparent material such as glass, is slid onto cluster/inner tube assembly 83 in order to help maintain monofilament alignment.

Referring to FIG. 6, the end of assembly 83 bearing the cluster of monofilaments 26 is inserted into a cap assembly 84 containing funnel 85 and plug 86 having centering pin 87. Funnel 85 and plug 86 may be formed of any suitable material such as a metal. To insert the end of assembly 83 into cap assembly 84, the end of inner tube 66 is first inserted into the funnel 85 until inner tube 66 engages centering pin 87. Monofilaments 26 are then slid along inner tube 66 into the flared end of funnel 85 until the monofilaments 26 are inserted the full depth into funnel 85. Glass funnels 81 and 82 may be backed off as needed to allow such insertion to occur, but preferably remain in position around the monofilament cluster. Insertion of monofilaments 26 into funnel 85 results in further packing of the monofilaments 26. Insertion into funnel 85 and the accompanying increased packing of the monofilaments 26 typically requires axial and rotational oscillation of funnel 85 while applying sufficient force to move monofilaments 26 along the longitudinal axis of the monofilament cluster. Once monofilaments 26 are inserted the full depth into funnel 85, the force required to continue passing the monofilament cluster through funnel 85 in subsequent processing steps, to be described below, thereafter decreases. Monofilaments 26 are now close to being in a hexagonal-close-packed array.

The use of the assembly 83 resultant from FIG. 6 will now be described with respect to FIGS. 4 and 6. Plug 86 is removed from assembly 83 and placed into one end of outer tube 70. Assembly 83 now comprising inner tube 66, the monofilament cluster, glass funnels 81 and 82, and funnel 85 are positioned at the other end of outer tube 70. With funnel 85 bearing against the outer tube 70, inner tube 66 itself is slid into bore 68 of outer tube 70 until inner tube 66 again engages pin 87 of plug 86. Monofilaments 26 are then slid through funnel and along the now stationary inner tube 66 until monofilaments 26 engage plug 87 at the other end of outer tube 70. Plug 87 is then removed and replaced with one of collars 72 or 74, as the case may be. Funnel 85 is also removed and replaced with the other collar.

With the monofilaments now located in cavity 78, collars 72 and 74 are fixedly secured to inner tube 66 and/or outer tube 70, as appropriate, in order to hermetically seal tubular cavity 78. Collars 72 and 74 may be secured in place using any suitable technique. Electron beam welding is a preferred technique for this purpose. FIG. 4 schematically shows the position of electron beam welds 88. Electron beam welds 88 may be formed using conventional techniques while placing assembly into a high vacuum (e.g., 0.2 torr). Such a vacuum facilitates propagation of the electron beam and removes air from monofilament-filled cavity 78. Such air, if left in cavity 78, could cause contamination and embrittlement of the resultant composite. Each weld 88 is orbital, extending circumferentially around the bond site. To achieve such a bond, the electron beam preferably is held stationery while the assembly is rotated about its longitudinal axis.

Next, tooling 62 is subjected to conditions under which the titanium-based coatings on monofilaments fuse together via diffusion bonding to form a binder matrix fibrously reinforced by the axially aligned refractory monofilaments. The titanium-based material also fuses via diffusion bonding to the titanium-based constituents of body 70 and inner tube 66, effectively bonding inner tube 66, the monofilament reinforced composite formed in tubular cavity 78, and body 70 together. According to a preferred approach, hot isostatic pressing techniques are used to accomplish such fusion. Generally, hot isostatic pressing involves placing tooling 62 in a pressurized gas at a high enough temperature for such diffusion bonding to occur. Any gas or combination of gases may be used so long as the gas or gases are inert with respect to the titanium-based materials used in body 70, inner tube: 66, and collars 72 and 74, respectively. Representative examples of suitable gases include inert gases such as nitrogen, helium, argon, combinations of these, and the like.

The temperature(s) and pressure(s) used for isostatic pressing should be selected to fuse the titanium-based coatings on the monofilaments through plastic deformation and diffusion, but should not so extreme as to structurally or mechanically harm body 70 and inner tube 66. For example, for embodiments in which inner tube 66 is formed from commercially pure titanium or Ti-6Al-2Sn-4Zr-2Mo and body 70 are formed from Ti-6Al-2Sn-4Zr-2Mo and the monofilament coatings are formed from Ti-6Al-4V, isostatic pressing desirably occurs at a temperature in the range from 850° C. to 950° C. Additionally, it is further desirable for isostatic pressing to occur at a pressure in the range of 30 MPa to 150 MPa, preferably 80 MPa to 120 MPa. Preferably, hot isostatic pressing occurs at 103 MPa pressure and 900° C. for two hours.

Figure 7:
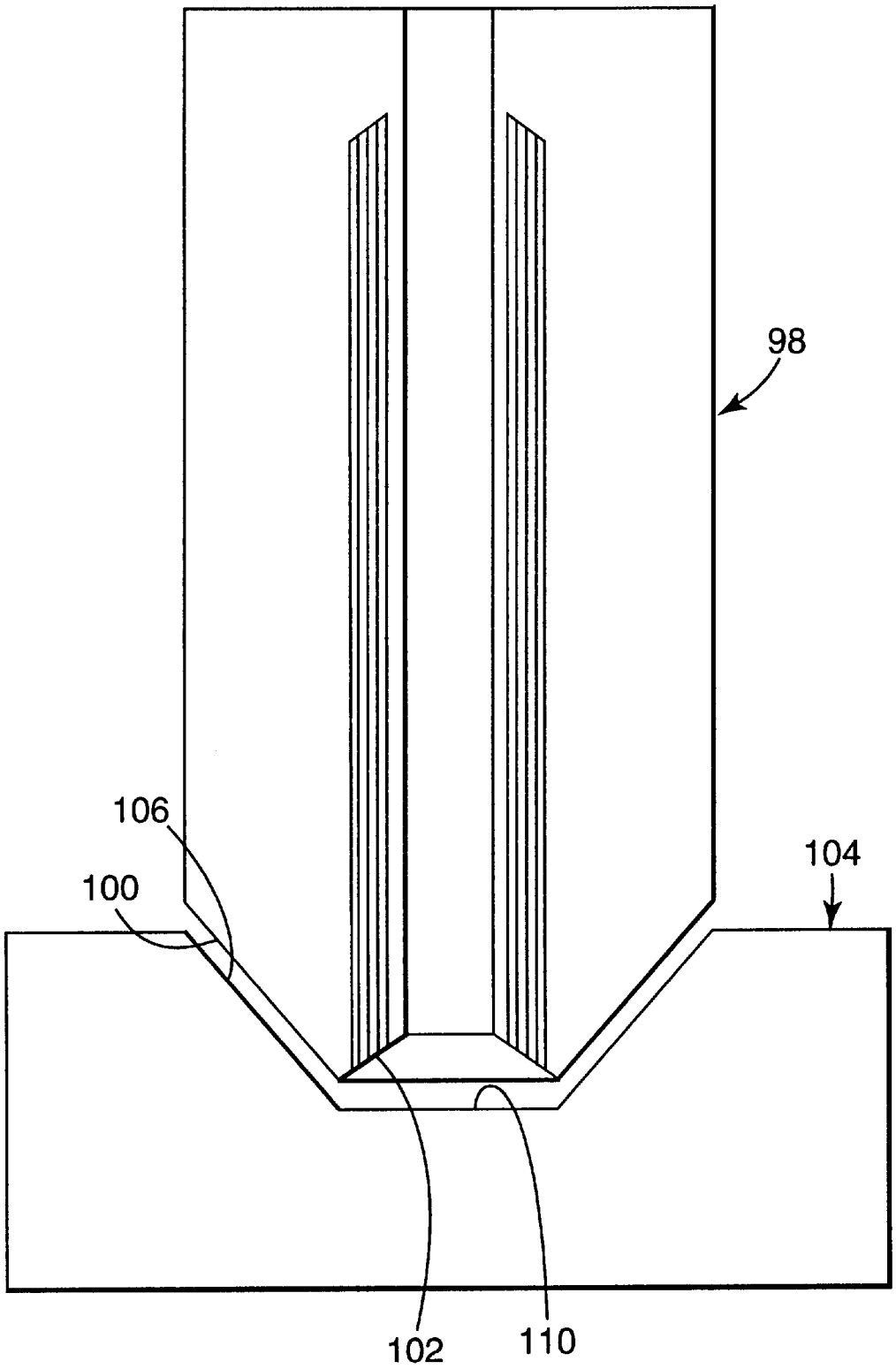
FIG. 7 shows a valve stem blank made using the tooling of FIGS. 4–6, and further shows a corresponding valve head blank of the present invention in position to be bonded to the valve stem blank (cross-section lines removed for clarity)

During hot isostatic pressing, the hot gas exerts pressure on all sides of tooling 62, including inner surface 90 of inner tube 66 defining lumen 76. The pressure biases the wall of inner tube 66 radially outward toward body 70. This compresses the coated monofilaments in tubular cavity 78 so that a solid, substantially pore free composite of the monofilaments in a binder matrix results. After hot isostatic pressing, the coated monofilaments, inner tube 66, and outer tube 70 are essentially a single, densified component. Tooling 62 is allowed to cool, and the ends of the tooling are cut off at the dotted lines A—A and B—B to provide a valve stem blank 98 as shown in FIG. 7. Part of collar 72 is retained near line A—A after the cuts. This extra material provides material and reinforcement for machining keeper groove 22 in the final valve configuration.

Referring to FIG. 7, one end of valve stem blank 98 is machined to provide conical taper 100 and inverted taper 102. Conical taper 100 provides a surface for bonding valve stem blank 98 to valve head blank 104. Inverted taper 102 helps form part of a flared cavity region in the resultant valve. The angles of conical taper 100 and inverted taper 102 are not particularly critical. Either taper can be machined with an angle corresponding to machine tooling on hand. For example, the angle of inverted taper may be 15° to 75°, but is typically 30° since drill bits of that configuration are readily available. The angle of conical taper 100 may be, for example, 2520 to 75°, preferably 30° to 60°, more preferably about 45°. Valve head blank 104 is machined with recess 106 having tapered sides corresponding to conical taper 100 and with bottom 110 corresponding to the bottom of the flared cavity region 58 in the resultant valve. The mating relationship between conical taper 100 and sides 106 can be clearly seen in FIG. 7. Because these surfaces will be diffusion bonded to each other, they should be smooth, clean, and closely fitting.

Figure 8:
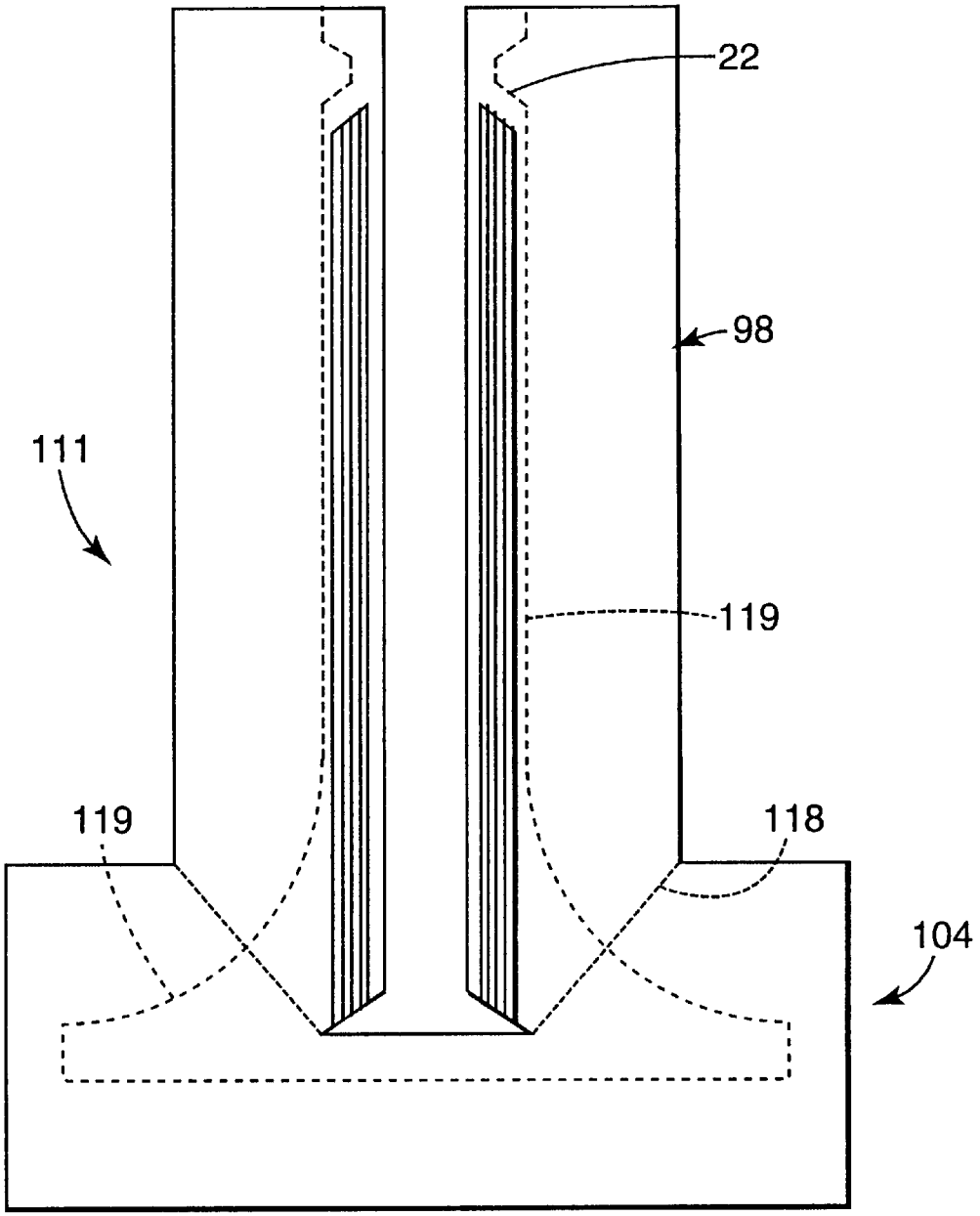
FIG. 8 is a valve body blank of the present invention formed by bonding the valve stem blank and valve head blanks of FIG. 7 together (cross-section lines removed for clarity)

FIG. 8 shows valve stem blank 98 bonded to valve head blank 104. Valve head blank 104 can be bonded to valve stem blank 98 using any suitable bonding technique. In preferred embodiments in which valve head blank 104 is formed from a titanium-based material, valve head blank 104 is preferably diffusion bonded to valve stem blank 98. Diffusion bonds between components formed from titanium-based materials are strong, and the bond line 118 between the components is practically indiscernible. Diffusion bonding therefore provides an assembled part that appears and behaves as if the assembled part was integrally formed from a single component.

To accomplish diffusion bonding, the mating surfaces are initially cleaned by a suitable technique such as immersing the components in an aqueous solution of nitric and hydrofluoric acids for two minutes. An example of one such acid solution includes 72 volume percent water, 26.5 volume percent of aqueous (70%) nitric acid, and 1.5 volume percent of aqueous (50%) hydrofluoric acid. The cleaned parts are then rinsed with water and dried. Diffusion bonding is then performed using a suitable apparatus such as a Centorr Vacuum Hot Press, Model M60-3×8-W-D02A2-A-20 machine (Centorr Furnaces, Ti Group, Nashua, N.H.). With this machine, the components are pressed together using graphite dies in the hot press.

The conditions used for diffusion bonding will depend upon a variety of factors, including the type of titanium-based materials used in valve stem blank 98 and valve head blank 104, the size of the blanks, and the like. As one example, carrying out diffusion bonding at about 900° C. at 100 to 400 psi for about 2 to 3 hours would be suitable for embodiments in which a Ti-6Al-2Sn-4Zr-2Mo alloy is used in valve head blank 104 and body 98.

After diffusion bonding is complete, the resultant valve blank 111 can be machined to the desired final dimensions to form a valve of the present invention. According to one approach, a computer-numerically controlled (C-NC) apparatus is programmed and used to machine the assembled blanks to the final shape, including formation of keeper groove 22. Dotted line 119 on FIG. 8 shows the outline of the corresponding final valve body. After such machining, a suitable valve tip (not shown) can be attached to the other end of the valve stem.

The approach for making valve 10A of FIG. 3 can be substantially the same, except that valve stem blank 98A (see FIG. 10) is substituted for valve stem blank 98. In comparing FIG. 10 to FIG. 7, both have an outer tube 70 of the same structure. However, in FIG. 10, portion 125A of the inner wall has thickened walls which corresponds to thickened portion 37A of the corresponding valve 10A in FIG. 3. Additionally, monofilaments 26A in FIG. 10 extend the full length of valve stem blank 98A.

The present invention will now be further described with reference to the following illustrative examples.

EXAMPLE 1

A Ti-6-2-4-2 alloy (6 wt % aluminum, 2 wt % tin, 4 wt % zirconium, 2 wt % molybdenum, and the balance titanium with other trace impurities, available from Americana Metal Service, Cincinnati, Ohio) rod, 2.5 cm in diameter and 14.22 cm in length, was gun drilled to produce a tube (see 70 in FIG. 4) having an outer diameter of 2.5 cm, an inner diameter of 0.86 cm. Both ends of the tube were machined to produce circumferential shoulders (see 71 in FIG. 4) adjacent to the inner diameter of the tube.

Approximately 600 Ti-6-4 coated silicon carbide fibers (available from the 3M Company, St. Paul, Minn. under the designation "98-0000-0456-8, Ti-6-4 COATED SCS-6 FIBERS") were cut into 11.77 cm lengths and manually assembled around a second, smaller titanium tube (see 66 in FIG. 4) and the fiber/tube array inserted into the flared end of a glass funnel (see 81 in FIG. 5) having an inner diameter 0.005 cm greater than the inside diameter of the outer Ti-6-2-4-2 tube. Slight rotational oscillation of the funnel and central tube facilitated movement of the individual fibers to increase the fiber packing density to approximate a hexagonal close-pack arrangement of the fibers around the titanium tube. The assembly was then rolled back and forth between the thumb and fore finger to further align the fibers, to reduce interfiber spacing, and to decrease the diameter of the array until it easily slid into the stem of the glass funnel. The aligned fiber/tube assembly was inserted into a second funnel (see 82 in FIG. 5) to help maintain the fiber alignment around the tube.

The second, smaller tube (66) was then extended through a metal funnel (see 85 in FIG. 6) to engage centering pin (see 87 in FIG. 6) of a metal plug (see 86 in FIG. 6). The fibers were then slid along the second, smaller tube 66, through the glass funnels until they engaged the flare of the metal funnel, which further reduced the outer fiber array diameter to 0.861 cm, the inner diameter of the outer Ti-6-2-4-2 tube, and produced concentricity of the central tube and surrounding fiber array. This reduction required axial rotational oscillation of the metal funnel while applyiig a slight longitudinal pressure along the fiber array.

Metal plug 86 was removed from the assembly shown in FIG. 6 and placed in one end of the outer Ti-6-2-4-2 tube (see 70 in FIG. 4). With funnel 85 bearing against the outer tube 70, inner tube 66 itself is slid into bore 68 of outer tube 70 until inner tube 66 again engages pin 87 of plug 86. The fibers were then slid along the now stationary inner tube until they engaged metal plug 86, after which metal funnel 85 was removed from the outer tube 70 and replaced with a first collar (see 72 in FIG. 4). Metal plug 86 was then removed and replaced with a second collar (see 74 in FIG. 4). The collars (72 and 74) had previously been machined to configure shoulders (see 73 and 75 in FIG. 4) on one end of their respective internal diameters. The opposite ends of the collars (72 and 74) were machined at a 45 degree angle to provide a graded transition zone (see 25 in FIG. 1) between the fibers and the monolithic titanium alloy at the top of the final valve stem. The inner tube (66) and collars (72 and 74) were rotated to ensure exact alignment and concentricity of the two tubes and fibers.

Collars 72 and 74 were then electron beam welded to inner tube 66 and outer tube 70 using standard electron beam welding techniques, producing welds (see 88 in FIG. 4) at the shoulders (see 71 in FIG. 4) of outer tube 70. The electron-beam welding operation was performed in a high vacuum environment which allows propagation of the electron beam and removes air from the fiber-filled cavity, reducing the likelihood of contamination and embrittlement of the composite stem. Each orbital weld was produced by rotating the tube/collar assembly around its longitudinal axis in front of a stationary electron beam.

The welded assembly was hot isostatic pressed in an argon atmosphere, at 103 Mpa pressure and 900° C. for 2 hours to consolidate the fiber/tube assembly into a unified, dense assembly. The unified assembly was cut along the lines A—A and B—B, shown in FIG. 4, retaining part of collar 72 near A—A, to provide material for machining the keeper groove in the final valve configuration. The unified assembly was then machined to a valve stem blank (see 98 in FIG. 7). A conical taper (see 100 in FIG. 7) was machined to a 45° degree taper and an inverted taper (see 102 in FIG. 7) was machined to a 30° degree taper.

A valve head blank (see 104 in FIG. 7) made from a Ti-6-2-4-2 alloy was machined from a round bar stock having a 4.45 cm diameter. A recess (see 106 in FIG. 7) was machined to produce close tolerance fits between the diameter of a bottom portion (see 110 in FIG. 7) of the recess (106) and the diameter of the apex of the conical taper (100) and the shoulder of recess (106) and conical taper (100). Close tolerance fits were used to produce optimum bonding in subsequent diffusion bonding of the two blanks. The valve head blank (see 104 in FIG. 7) and valve stem blank (see 98 in FIG. 7) are illustrated in cross-section of FIG. 7 as they appeared prior to bonding.

Immediately prior to diffusion bonding, the blanks were cleaned by immersing the components in an aqueous acidic solution (72 vol. % deionized water, 26.5 vol. % nitric acid (70%), and 1.5 vol. % hydrofluoric acid (50%)) for two (2) minutes, rinsing with deionized water and then air drying. The cleaned valve head and stem blanks were welded together by diffusion bonding in a vacuum hot press (Model M60-3×8W-D-02A2-A-20 Centorr Furnaces, Ti Group, Nashua, N.H.) using standard diffusion bonding techniques. The blanks (98 and 104) were positioned as illustrated in FIG. 7 and pressure applied to the top of the valve stem blank and the bottom of the valve head blank via graphite dies in the hot press. Gas pressure inside the hot press was $10^{-7}$ to $10^{-6}$ Pa. The stem and head blanks were held under nominal contact pressure (0.1 MPa) during an approximate 20 minute heat-up cycle to 900° C. Contact pressure of 5 MPa was applied to the blanks for approximately 2 hours at 900° C., followed by cooling the furnace to room temperature under the same applied pressure. Examination of a cross-section of the bond area under an optical microscope at 400× magnification revealed no visible evidence of a bond line, typically caused by oxide residues, at the juncture of the two blanks after diffusion bonding as titanium based alloys were believed to have dissolved their own oxides, effectively making the bond line disappear.

A hollow stem valve was machined from this unified structure using CNC (computer-numerically controlled) machining techniques to produce a valve (see 10 in FIG. 1). A hardened steel end cap (see 40 in FIG. 1) was press fit into a lumen (see 20 in FIG. 1) of the valve stem 12, with a knurled shank (see 47 in FIG. 1) engaging the inner diameter of lumen 20. End cap 40 was made from a direct-hardening alloy steel, AISI/SAE 4340 (0.4 wt % carbon, 0.6 wt % manganese, 1.2 wt % chromium, 1.5 wt % nickel and 0.15% molybdenum), hardened to Rockwell 60 (available from American Metal Service, Cincinnati, Ohio) to provide a hard, wear resistant surface where the valve contacts the rocker arm.

Valve heads are subject to bending as the head moves on and off the valve seat in an operating engine. The valve (see 10 in FIG. 1) was designed to position the apex (see 43 in FIG. 1) of a flared cavity (see 58 in FIG. 1) close to the neutral stress axis (i.e., the point of minimum bending motion) of the valve head (see 42 in FIG. 1). If apex 43 were not positioned at the neutral bending axis it is believed that a crack tip would propagate cracks in the valve head, leading to premature valve failure as it flexed during operation. Note that the position of the neutral axis will be different for different valve shapes and sizes.

Referring again to the cross-section schematic of FIG. 1, valve 10 was designed so that the ends of fibers 26 were not terminated in the titanium alloy matrix in the valve head. It is believed that if fibers 26 terminated in the titanium alloy matrix, chemical reaction between the fibers and the titanium alloy would have created embrittlement and fatigue-initiation sites. This valve was designed to allow the valve load stresses to transfer from the fibers to the titanium alloy within the head, without the presence of fatigue initiation sites.

The titanium matrix composite valve was tested (by Crower Cams and Equipment Company, Chula Vista, Calif.) in an engine valve train simulator consisting of engine block with a camshaft driven by an auxiliary motor and a single valve train consisting of a valve lifter, a pushrod, a rocker arm, a valve spring and a valve. The valve train was set-up on the simulator, and the system run using a commercially available titanium racing engine valve (Manley Performance Products Lakewood, N.J.) and the Example 1 titanium matrix composite valve. The valve motion was analyzed using a valve motion analyzer (available under the trade designation "OPTRON" Model 806B Valve Motion Analyzer, Optometrix, Woodbridge, Conn.) focusing on the simulator rpm at which the valve begins to "float" or bounce on the valve seat. The rpm at which valve float occurred was deemed to represent the maximum or upper limit of engine speed for that valve. A conventional solid stem titanium valve (available from Manley Performance Products), which weighed 84 g, exhibited primary valve float at around 7700 rpm, and hard float at 8000 rpm. The hollow stem titanium matrix composite valve of Example 1, which weighed 66 g, exhibited soft float at 8050 rpm and hard float at 8250 rpm. Based on the simulator testing, the useful range of an engine equipped with the lightweight, hollow stem valve versus the heavier conventional solid stem valve would be 350 rpm greater and the maximum capability increased by about 250 rpm.

EXAMPLE 2

Figure 9:
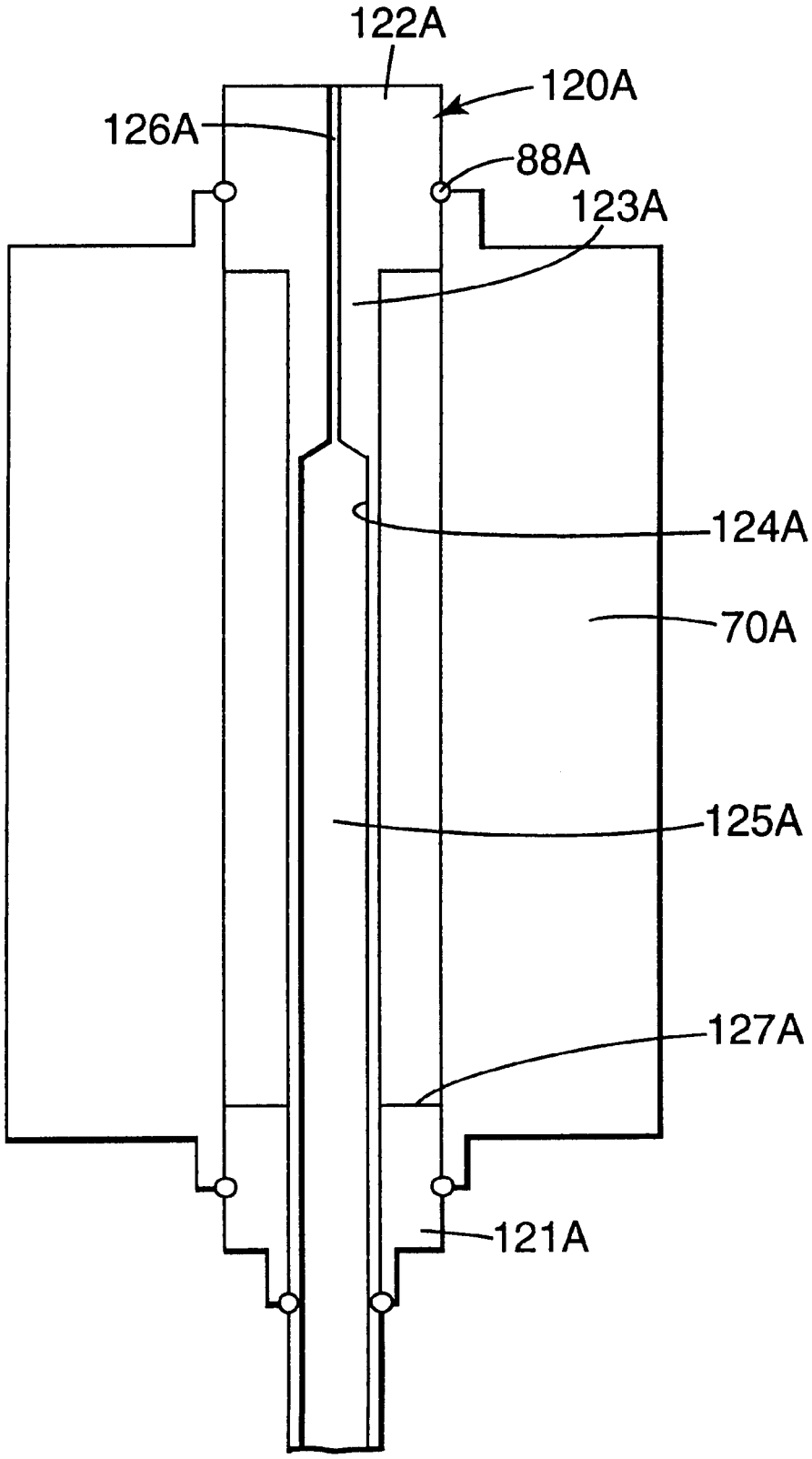
FIG. 9 is a side view, in cross-section, of tooling useful for making the valve stem of FIG. 3 (cross-section lines removed for clarity)

A hollow stem titanium alloy composite valve was prepared as described in Example 1 except that tube 66 was replaced with a central tube which incorporated an integral top collar (see 120A in FIG. 9). Central tube 120A, which was made of a Ti-6-2-4-2 alloy, was machined from a 1.25 cm diameter rod of the Ti-6-2-4-2 alloy (available from Americana Metal Service) by first gun drilling the larger portion of the central lumen (see 125A in FIG. 9) to the same inner diameter as tube 66 in FIG. 1. The smaller diameter portion (see 126A in FIG. 9) of the central lumen was subsequently gun drilled from the opposite end of the rod. The thus produced tube was machined, using standard machining techniques, to produce central tube 120A, incorporating thin wall portion (see 124A in FIG. 9) having substantially the same thickness as tube 66. The thicker, upper portion (see 122A of FIG. 9) of central tube 120A replaced the discrete collar 72 illustrated in FIG. 1 and the thickened wall portion (see 123A of FIG. 9) provided reinforcement to the region of the valve stem where the valve keeper eventually was machined from the valve blank. Bottom collar 74 of FIG. 4 was also replaced with a collar (see 121A in FIG. 9) which had a flat surface (see 127A in FIG. 9) contacting the ends of fiber 26A. The use of central tube 120A required only 3 electron-beam welds (see 88A in FIG. 9) before HIPing instead of the four welds required by the tooling illustrated in FIG. 4.

Figure 10:
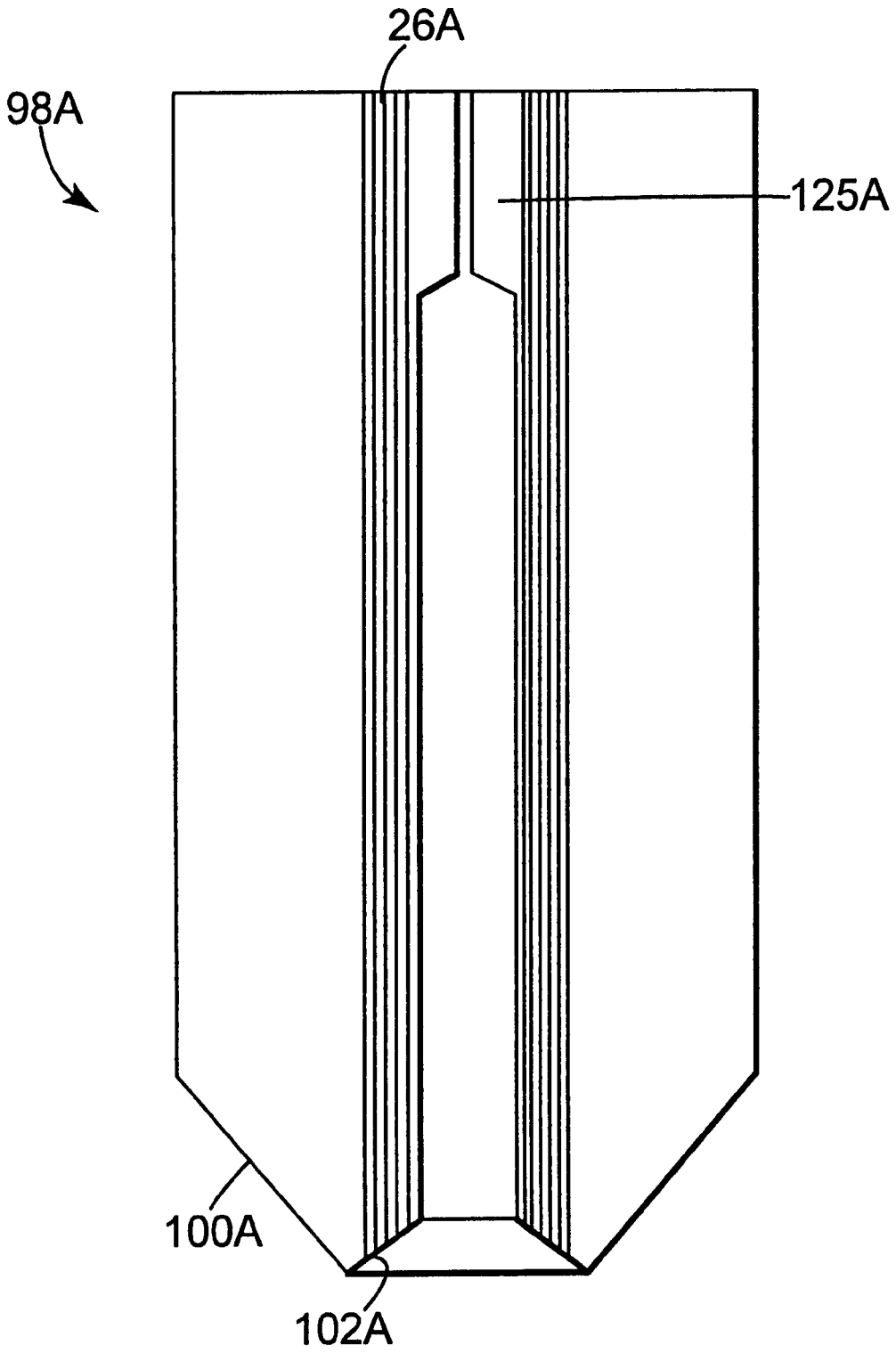
FIG. 10 shows a valve stem blank made using the tooling of FIG. 9 (cross-section lines removed for clarity).

FIG. 10 shows the construction of the hollow valve stem blank 98A after HIPing, cutting, and machining. The difference in wall thickness in the keeper region is readily seen in a comparison of the schematic cross-section of blanks 98A (FIG. 10) and 98 (FIG. 7) or as thickened wall section 37A of finished valve 12A in FIG. 3. In addition, fibers 26A extended to the tip of the valve stem, as is illustrated in the cross-section schematic of finished valve 12A.

Performance of this valve construction was also tested in a valve train simulator as described in Example 1 except that a laser valve motion analyze fixture (available under the trade designation "SPINTRON" from Trend Performance Products, Warren, Mich.) was used by Competition Cams of Memphis, Tenn. to analyze the valve motion. This simulator utilized a very aggressive valve train and cam (i.e. higher lift and higher valve velocity and acceleration), similar to a typical valve train set-up used in US Stock Car Racing. In this test simulation, a standard steel valve (available from Manley Performance Products, Lakewood, N.J.), weighing 120 g, exhibited hard float at a maximum rpm of 8300 rpm, a standard titanium valve (available from Manley Performance Products) weighing 74 g, exhibited hard float at a maximum rpm of 8800 rpm, and the hollow stem titanium matrix composite valve of Example 2, weighing 54 g, did not exhibit hard float at up to 9400 rpm, at which point the test was stopped to prevent damage to other valve train components.

Other embodiments of this invention will be apparent to those skilled in the art upon consideration of this specification or from practice of the invention disclosed herein. Various omissions, modifications, and change, to the principles and embodiments described herein may be made by one skilled in the art without departing from the true scope and spirit of the invention which is indicated by the following claims.

What is claimed is:

1. A valve for an internal combustion engine, comprising:

(a) a valve stem comprising a first end, a second end, and a longitudinal axis extending from the first end to the second end, said valve stem comprising a composite, said composite comprising:

(i) a titanium-based metal binder matrix; and (ii) an axially aligned cluster of refractory monofilaments incorporated into the binder matrix; and (b) a valve head provided at the first end of the valve stem.

2. The valve of claim 1, further comprising a valve tip provided at the second end of the valve stem.

3. The valve of claim 1, wherein the valve stem is hollow such that the valve stem includes an inner wall and an outer wall.

4. The valve of claim 3, wherein the valve stem comprises substantially monofilament-free regions lining the inner and outer walls of the valve stem.

5. The valve of claim 4, wherein the inner and outer regions each independently comprise a titanium-based metal.

6. The valve of claim 1, wherein the valve stem is hollow such that the valve stem includes a first inner wall and a first outer wall each adjacent to said first end and a second inner wall and a second outer wall each adjacent to a second end, where the thickness between said first inner and outer walls as defined by the shortest distance therebetween is greater than the thickness between second inner and outer walls as defined by the shortest distance therebetween.

7. The valve of claim 1, wherein the refractory monofilaments comprise silicon carbide.

8. The valve of claim 7, wherein substantially no monofilament directly contacts another monofilament of the cluster such that substantially all of the monofilaments are spaced apart from each other.

9. The valve of claim 7, wherein at least a portion of the silicon carbide monofilaments extend substantially continuously from the first end to the second end of the valve stem.

10. The valve of claim 1, wherein the valve head comprises a titanium-based metal.

11. The valve of claim 10, wherein the valve head comprises a flared cavity region, wherein the monofilaments at said second end of the valve stem include monofilament ends that are spaced apart from and do not directly contact the titanium-based metal of the valve head.

12. The valve of claim 11, wherein the flared cavity region has an apex positioned substantially at a neutral bending axis of the valve head.

13. The valve of claim 3, wherein the refractory monofilaments comprise silicon carbide.

14. The valve of claim 3, wherein the valve stem comprises substantially monofilament-free regions lining the inner and outer walls of the valve stem.

15. The valve of claim 3, wherein at least a portion of the silicon carbide monofilaments extend substantially continuously from the first end to the second end of the valve stem.

16. The valve of claim 11, wherein the refractory monofilaments comprise silicon carbide.

17. The valve of claim 11, wherein the valve stem comprises substantially monofilament-free regions lining the inner and outer walls of the valve stem.

18. The valve of claim 11, wherein at least a portion of the silicon carbide monofilaments extend substantially continuously from the first end to the second end of the valve stem.

19. A method of making an internal combustion engine valve of the type in which a valve head is attached to a valve stem having a longitudinal axis, comprising the steps of:

(a) providing a cluster of axially aligned, refractory monofilaments, wherein each monofilament comprises a coating including a titanium-based metal or titanium alloy;

(b) subjecting the cluster of axially aligned, coated monofilaments to conditions effective to form a composite comprising said monofilaments incorporated in a binder matrix comprising the titanium-based metal; and (c) incorporating at least a portion of the composite into the valve stem of the valve such that the monofilaments of the composite are substantially parallel to the longitudinal axis of the stem.

20. The method of claim 19, wherein the forming step comprises forming a tubular cluster of said monofilaments positioned in a cavity between an inner tube concentrically supported in a bore of an outer tube.

21. The method of claim 19, wherein step (b) is carried out under conditions such that substantially no monofilament directly contacts another monofilament of the cluster such that substantially all of the monofilaments are spaced apart from each other.

22. The method of claim 19, wherein substantially all of the monofilaments of the cluster have a length corresponding to the length of the valve stem.

23. The method of claim 19, wherein step (b) includes subjecting the cluster to hot isostatic pressing under conditions effective to cause the titanium based metal coatings of the monofilaments to fuse together to form at least a portion of the binder matrix.

24. The method of claim 23, wherein:

(1) step (b) includes comprises positioning the cluster of monofilaments in a tubular cavity of an assembly formed from an inner tube concentrically supported in a bore of an outer tube; and (2) hot isostatically pressing the assembly under conditions effective to provide said composite body.

25. The method of claim 24, wherein step (c) includes attaching a valve head blank to the fused assembly and machining the resultant combination to form the valve.

26. The method of claim 25, further including the steps of machining an end of the fused assembly with an inverted taper and attaching said machined end to the valve head blank such that monofilaments at said machined end are spaced apart from directly contacting the valve head.

* * * * *

UNITED STATES PATENT AND TRADEMARK OFFICE

CERTIFICATE OF CORRECTION

PATENT NO. : 6,009,843
DATED : January 4, 2000
INVENTOR(S) : Christopher J. Griffin, Charles J. Skowronek, James P. Sorenson It is certified that error appears in the above-identified patent and that said Letters Patent is hereby corrected as shown below:

Column 1,
Line 13, "Lise" should read -- use --;
Line 16, "example.," should read -- example, --;

Column 3,
Line 45, "13" should read -- 18 --;

Column 6,
Line 49, "rmlay" should read -- may --;

Column 8,
Line 52, "Ti-baised" should read -- Ti-based --;

Column 10,
Line 11, "25" should read -- 25 --;

Column 12,
Line 21, "not so" should read -- not be so --;
Line 59, "2520" should read -- 25° --;

Column 13,
Line 37, "C-NC" should read -- CNC --;

Column 14,
Line 27, "applyiig" should read -- applying --.

Signed and Sealed this

Nineteenth Day of March, 2002

*Attest:*

*Attesting Officer*

JAMES E. ROGAN
*Director of the United States Patent and Trademark Office*